US007176397B2

(12) United States Patent
Grzan

(10) Patent No.: US 7,176,397 B2
(45) Date of Patent: Feb. 13, 2007

(54) WATER RESISTANT SWITCH MAT HAVING ACTIVATION ACROSS ITS ENTIRE SURFACE

(75) Inventor: John Grzan, Brentwood, NY (US)

(73) Assignee: Tapeswitch Corporation, Farmingdale, NY (US)

( * ) Notice: Subject to any disclaimer, the term of this patent is extended or adjusted under 35 U.S.C. 154(b) by 95 days.

(21) Appl. No.: 11/051,147

(22) Filed: Feb. 4, 2005

(65) Prior Publication Data

US 2006/0175184 A1 Aug. 10, 2006

(51) Int. Cl.
*H01H 35/36* (2006.01)

(52) U.S. Cl. ..... 200/85 R; 200/512; 200/334; 200/302.1

(58) Field of Classification Search ..... 200/302.1, 200/511–512, 85 R, 86 R, 85 A, 329, 334
See application file for complete search history.

(56) References Cited

U.S. PATENT DOCUMENTS 5,510,586 A 4/1996 Hacking
5,602,428 A 2/1997 Schultz et al.
5,856,641 A * 1/1999 Schreiber et al. ..... 200/1 B
6,054,658 A 4/2000 Duhon et al.
6,054,664 A * 4/2000 Ariga et al. ..... 200/512
6,531,951 B2 * 3/2003 Serban et al. ..... 338/47
6,774,331 B1 8/2004 Den Ridder et al.

* cited by examiner

*Primary Examiner*—K. Lee
(74) *Attorney, Agent, or Firm*—Hoffmann & Baron, LLP

(57) ABSTRACT

An electrical switch mat which generally includes a first layer of flexible matting material, a second layer of flexible matting material, and a perimeter ribbon switch disposed between the first layer and the second layer. The ribbon switch has a longitudinal edge and is operable under pressure between a closed condition and an open condition and maintained in one of the open and closed conditions in the absence of pressure. The first and second layers have a peripheral edge which is aligned with the longitudinal edge of the ribbon switch in a coplanar relationship to form a peripheral edge of the electrical switch mat.

20 Claims, 3 Drawing Sheets

WATER RESISTANT SWITCH MAT HAVING ACTIVATION ACROSS ITS ENTIRE SURFACE

BACKGROUND OF THE INVENTION

The present invention relates generally to pressure activated switches, and more particularly, to a sensing mat having pressure activated switches contained therein for optimum surface area activation.

Various types of electrical switch mats are known in the art. Electrical switch mats have been designed for use in many different applications including use in floor mats for security, safety or other purposes to detect movement of objects or pedestrian traffic thereover. For example, it is known in the art to provide sensing mats or switch mats as part of a safety system to protect persons from injury from dangerous machinery and industrial equipment. Examples of such safety systems utilize switch mats connected to a machine controller for terminating power to the machine if someone steps on or off the mat.

Generally, electrical switch mats include one or more pressure-actuated switches incorporated within a floor mat material which protects the switch against wear. For example, normally open and normally closed pressure-sensitive electrical ribbon switches have been incorporated into numerous designs for electrical switch mats. Open and closed pressure-sensitive ribbon switches generally include a pair of either spaced or closed conductors respectively supported in an insulative jacket. Generally, relatively light pressure on the jacket will close the space in an open switch and open the conductors in a close switch thereby activating the switch. Thus, someone stepping on or off an electrical switch mat having a ribbon switch incorporated therein will activate the switch.

Electrical switch mats as described above have been extremely useful in detecting and responding to the presence, or absence, of the operator or others anywhere on its sensing surface, wherein the sensing surface is defined as the area covered by a single mat or a plurality of mats in combination. In one typical application, one or more sensing mats are placed directly in front of a piece of machinery, wherein the machine operator stands on the mat during operation of the machinery. If the operator steps off the mat, or if someone else steps on the mat, the switch mat is activated to terminate power to the machine. In another application, the dangerous equipment may be surrounded by a plurality of switch mats to define a danger zone, wherein a person entering the danger zone will step on a mat, thereby activating a switch to terminate power to the equipment.

Many of the pressure-actuated electrical switch mats presently in use generally include a major planar pressure-sensitive surface defining an active area. Pressure applied to the mat at this active area, for example by pedestrian traffic or movement of objects thereover, activates the switching device contained in the mat. However, mats of this type also typically include a perimetrical boundary or edge which is not sensitive to pressure. This "pressure-inactive" edge, while relatively small in comparison to the active pressure-sensitive surface, still provides an area which, when subjected to pressure, will not activate the switching device contained within the mat. The expanse of the inactive area is multiplied where several mats are used in juxtaposition in situations where it is desired to increase the sensing area. In particular, by abutting the inactive edges of the mats adjacent one another, the inactive area may be wide enough so that certain pedestrian traffic or movement of objects may not be detected. This results in the mats not producing the desired effect, i.e., the detection of movement of objects or people thereacross.

This problem was addressed in commonly owned U.S. Pat. No. 5,510,586 to Hacking, wherein a pressure-sensitive electrical switching device is disclosed for providing pressure-sensitive continuity between a pair of pressure-sensitive electrical switch mats, where each mat includes a major planar active area and an inactive edge. The switching device is positioned between a pair of pressure-sensitive electrical switch mats along abutting inactive edges thereof so that the area of pressure inactivity defined by the edges of the mats is eliminated.

U.S. Pat. No. 5,602,428 to Schultz et al. also proposed a switching device in the form of a bridge connector interposed between two adjacent switch mats to eliminate the inactive edge zone of each mat. The bridge connector spans over the inactive zone of each mat and connects the active zones so that pressure applied to the bridge connector will activate one or both of the adjacent mats.

The switch mat disclosed in commonly owned U.S. Pat. No. 6,054,658 to Duhon et al. does away with additional splicing or interconnecting switching devices, while at the same time maintaining an active edge zone on the mat. This is achieved by providing a rigid frame construction to the mat for supporting a ribbon switch at the perimeter edge of a top plate member of the mat. Thus, a switch mat is provided which has an activation surface encompassing the entire surface area of the mat.

It would be desirable to further improve upon the switch mat disclosed in the above U.S. Pat. No. 6,054,658 to Duhon et al. In particular, it would be desirable to provide a fully flexible, water resistant switch mat that is simply constructed and has activation across its entire surface.

SUMMARY OF THE INVENTION

The present invention is an electrical switch mat which generally includes a first layer of flexible matting material, a second layer of flexible matting material, and a perimeter ribbon switch disposed between the first layer and the second layer. The ribbon switch has a longitudinal edge and is operable under pressure between a closed condition and an open condition and maintained in one of the open and closed conditions in the absence of pressure. The first and second layers have a peripheral edge which is aligned with the longitudinal edge of the ribbon switch in a coplanar relationship to form a peripheral edge of the electrical switch mat.

In a preferred embodiment, the electrical switch mat further includes at least one interior ribbon switch disposed between the first layer and the second layer and spaced inwardly from the perimeter ribbon switch. In this manner, the electrical switch mat is pressure-sensitive across the entire surface of the first and second layers. Also, the peripheral edges of the first and second layers are bonded together with the longitudinal edge of the ribbon switch to form a continuous perimeter of the switch mat. The flexible matting material of the first and second layers is preferably an elastic water-resistant material and the first layer of flexible matting material may include an inclined ramp portion adjacent the peripheral edge for minimizing tripping on the switch mat.

Preferably, the perimeter ribbon switch includes a pair of vertically spaced electrical conductors enclosed in an insulative jacket. The conductors are urged into electrical engagement upon compression of at least one of the first and second layers to activate the perimeter ribbon switch. Particularly with rectangular switch mats, the perimeter ribbon switch preferably has a first switch portion electrically and structurally connected to a second switch portion, wherein the first and second switch portions define a corner. More specifically, the vertically spaced electrical conductors and the insulative jacket of the first and second switch portions are joined together at the corner to maintain electrical and structural continuity. Preferably, the electrical conductors and insulative jacket of the first switch portion are joined to the electrical conductors and insulative jacket of the second switch portion at about a 45 degree angle.

As a result of the present invention, two or more such electrical switch mats can be joined together in abutting fashion, whereby there are no inactive areas of pressure sensitivity between the mats. In this regard, the longitudinal edge of one switch mat ribbon switch preferably abuts against the longitudinal edge of its adjacent switch mat ribbon switch.

These and other objects, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
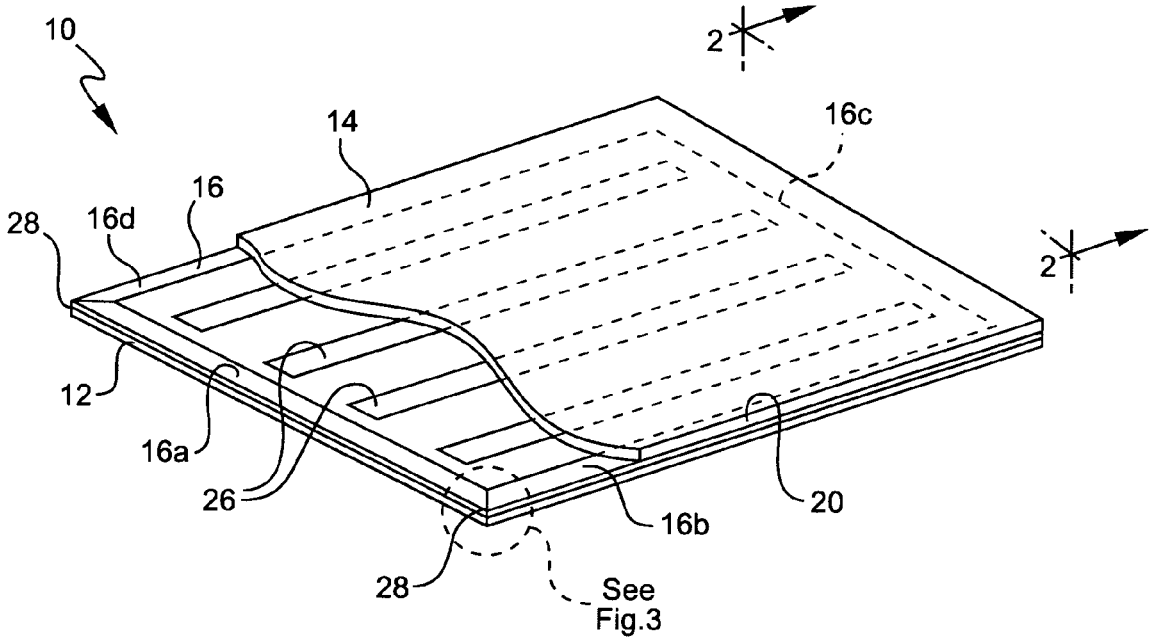
FIG. 1 is a top perspective view of the electrical switch mat of the present invention with the top layer shown partially cut-away.
Figure 2:
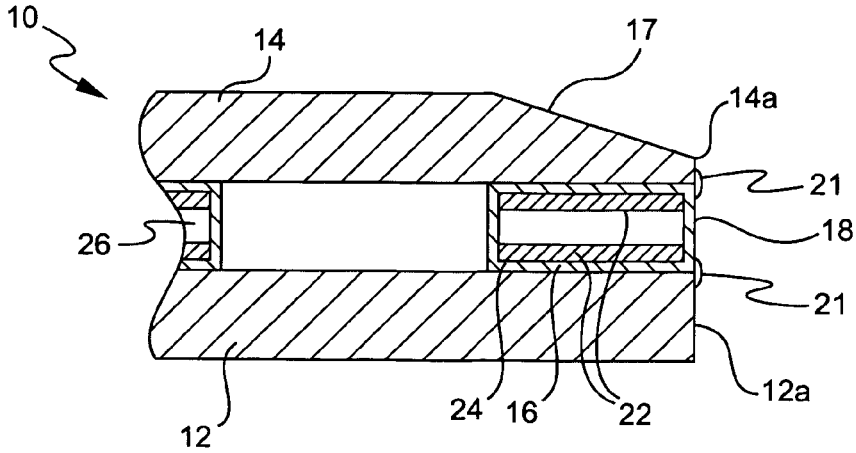
FIG. 2 is a cross-sectional view of the electrical switch mat shown in FIG. 1 taken along the line 2—2.

Referring first to FIGS. 1 and 2, an electrical switch mat 10 formed in accordance with the present invention is shown. The electrical switch mat 10 generally includes a first layer 12 of flexible matting material, a second layer 14 of flexible matting material and a perimeter ribbon switch 16 disposed in a laminated manner between the first and second layers. The flexible matting material is preferably a durable elastic and water-resistant material, such as a polyvinyl chloride (PVC) material.

Figure 3:
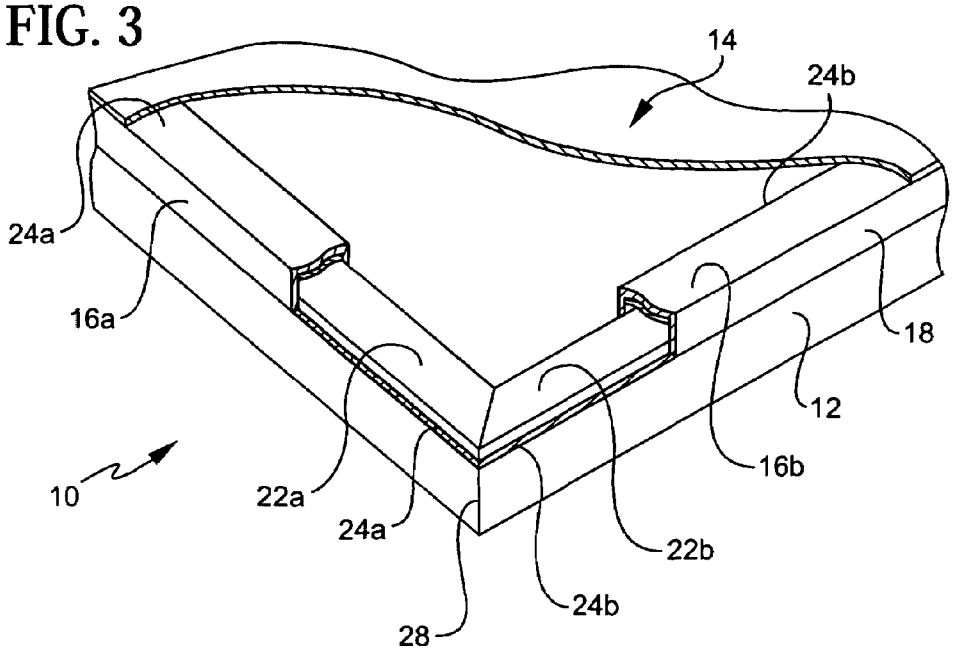
FIG. 3 is an enlarged detail view of a corner of the switch mat shown in FIG. 1.

The first and second layers 12 and 14 are of the same size and shape so that their respective peripheral edges 12*a* and 14*a* will be aligned when the layers are laminated together. As shown in FIGS. 1–3, the first layer 12 forms the bottom of the switch mat 10, which would generally rest against a floor surface, and the second layer 14 forms the top of the switch mat, which would generally be subject to pedestrian or other traffic. Preferably, the top layer 14 includes an inclined ramp portion 17 which gradually slopes upwardly from the peripheral edge 14*a* of the top layer toward the interior of the mat. The inclined ramp portion 17 of the top layer 14 provides a transition between the floor and the top of the switch mat 10 to minimize persons tripping on the switch mat.

The ribbon switch 16 is disposed between the first and second layers 12 and 14 at the peripheral edges 12*a* and 14*a* thereof so that a longitudinal edge 18 of the ribbon switch is aligned in a vertical coplanar relationship with the peripheral edges of the layers, as shown in FIG. 2, to form the peripheral edge 20 of the switch mat 10. Preferably, the respective edges 12*a*, 14*a* and 18 of the first layer 12, the second layer 14 and the ribbon switch are bonded together along the entire perimeter of the switch mat 10 so as to form water-tight seals 21 between the switch and the layers. The bonding can be achieved in a conventional manner, such as with a suitable adhesive or a heat-sealing method.

The perimeter ribbon switch 16 is operable under pressure between a closed condition and an open condition and is maintained, in this case, in the opened condition in the absence of pressure. The ribbon switch 16 can be a conventional open-style ribbon switch, as described above, which generally includes a pair of vertically spaced electrical conductors 22 enclosed in an insulative jacket 24. Compression applied to either the first layer 12 or the second layer 14 transfers pressure to the insulative jacket 24 causing the pair of electrical conductors 22 to move into electrical engagement. Alternatively, the ribbon switch 16 can be a closed-type ribbon switch wherein pressure applied to the switch interrupts the electrical engagement of the contacts.

In a preferred embodiment, the switch mat 10 further includes a plurality of interior ribbon switches 26 disposed between the first and second layers 12 and 14 and spaced inwardly from the peripheral edge 20 of the switch mat. The number and arrangement of the interior ribbon switches 26 is chosen to provide pressure-sensitive switch activation over the entire surface of the switch mat 10. In particular, the interior ribbon switches 26 are preferably arranged between the first and second layers 12 and 14 in rows along the entire length of the switch mat with minimal spacing between the rows. In this manner, pressure applied anywhere on the switch mat 10 will activate at least one of the ribbon switches. Here too, the interior ribbon switches 26 can be adhesively bonded to one or both of the first and second layers 12 and 14 in a conventional manner.

As mentioned, the ribbon switch 16 preferably extends around the entire perimeter of the switch mat. In this regard, particularly in the case of rectangular switch mats, the ribbon switch 16 may consist of several switch portions 16*a*, 16*b*, 16*c* and 16*d* joined together to form the switch mat perimeter. Specifically with rectangular switch mats as shown in FIG. 1, first, second, third and fourth switch portions 16*a*, 16*b*, 16*c* and 16*d* are joined together at the corners 28 of the switch mat 10. Preferably the strip portions 16*a*, 16*b*, 16*c* and 16*d* are internally spliced together at a 45 degree angle at each corner 28 of the switch mat 10. More particularly, the internal conductors 22*a* of the first switch portion 16*a* are electrically and structurally joined to the internal conductors 22*b* of the second switch portion 16*b* at a 45 degree angle, as shown in FIG. 3. The joining of the conductors 22*a* and 22*b* can be done, for example, by soldering. Similarly, the insulative jacket 24*a* of the first switch portion 16*a* is joined to the insulative jacket 24*b* of the second switch portion 16*b* to maintain closure of the ribbon switch at the junction point. This sealing can be done, for example, with a suitable adhesive or by heat sealing.

Figure 4:
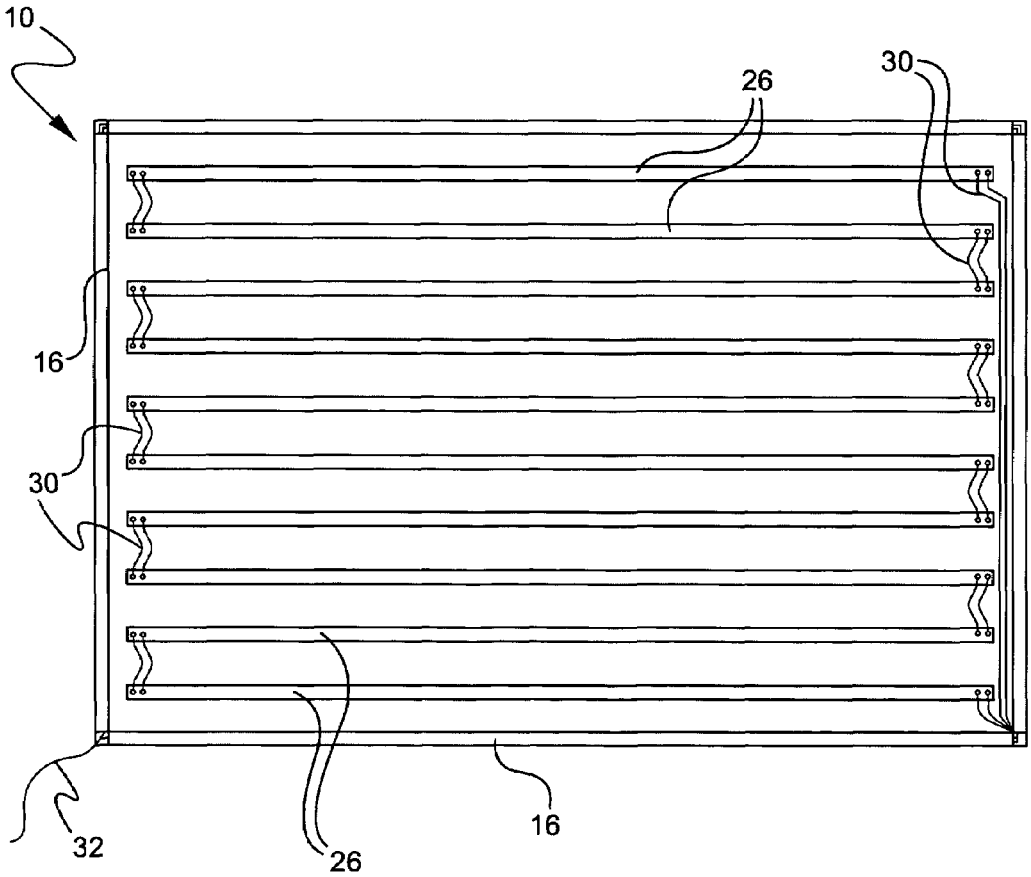
FIG. 4 is an electrical schematic diagram of the switch mat formed in accordance with the present invention.

Referring to FIG. 4, the perimeter ribbon switch 16 and the plurality of interior ribbon switches 26 can be electrically connected to each other in a conventional manner with wire leads 30 to maintain electrical conductivity between electrical conductors of the ribbon switches. Moreover, an external wire lead 32 may also be provided to electrically connect the plurality of switches 16 and 26 to a control unit (not shown).

Figure 5:
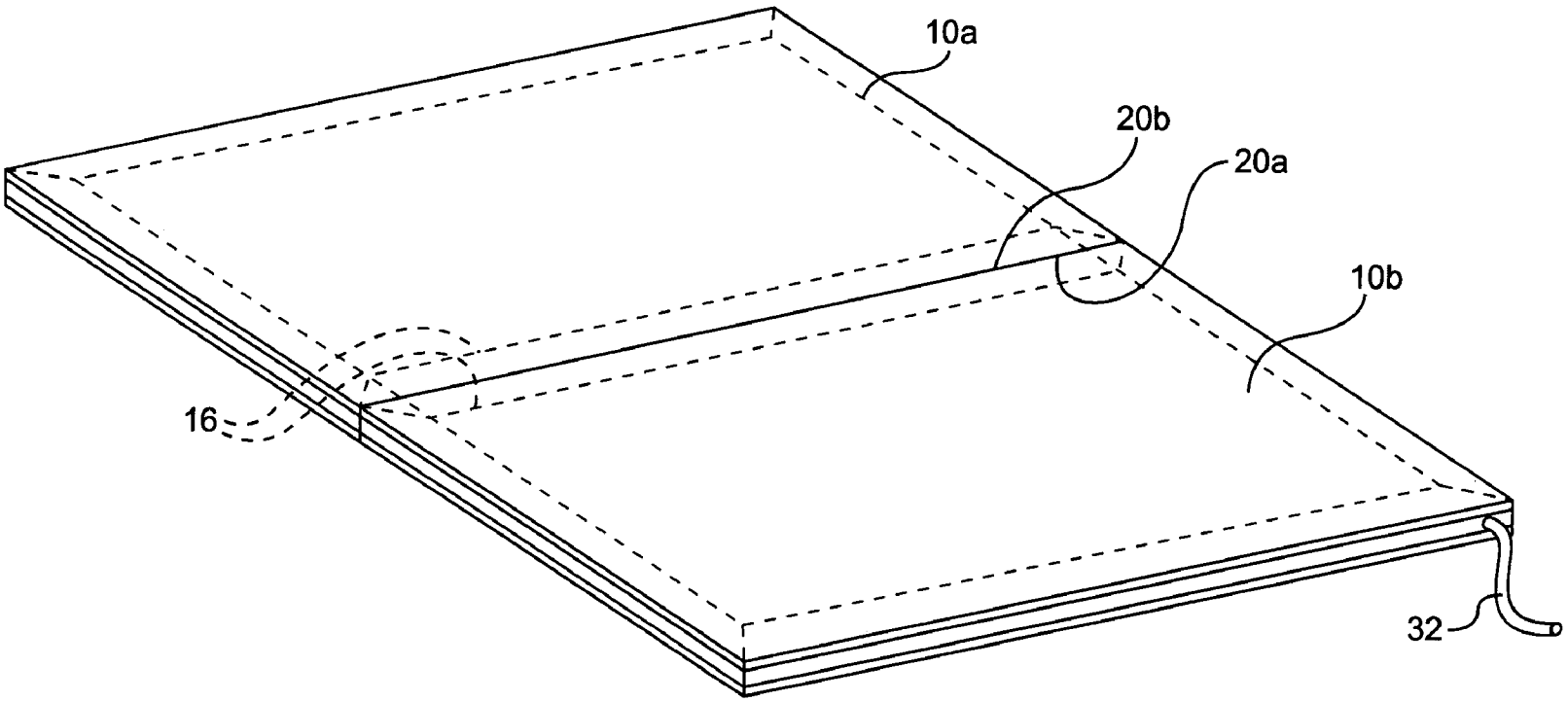
FIG. 5 is a top perspective view of a pair of electrical switch mats of the present invention joined together.

FIG. 5 shows two electrical switch mats 10*a* and 10*b* of the present invention joined together. Preferably, the adjacent peripheral edges 20*a* and 20*b* of the adjoining switch mats 10*a* and 10*b* abut together so that there is no empty space between the mats. In this regard, it is preferred to have the longitudinal edges 18 of the adjacent ribbon switches of each mat abut each other. The switch mats 10*a* and 10*b* can be joined together in any conventional manner so long as the peripheral edges remain in contact.

As a result of this adjoining mat arrangement, there are no inactive areas of pressure-sensitivity between the mats 10*a* and 10*b*. In other words, pressure applied at any point along the adjoining switch mat edges 20*a* and 20*b* will activate at least one of the ribbon switches in the switch mats 10*a* and 10*b*. Also, since each switch mat 10*a* and 10*b* includes a plurality of interior ribbon switches 26, the switch mats have pressure-sensitive activation across their entire respective surfaces.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical switch mat comprising:

a first layer of flexible matting material, said first layer having a peripheral edge;

a second layer of flexible matting material, said second layer having a peripheral edge; and a perimeter ribbon switch disposed between said first layer and said second layer, said ribbon switch having a longitudinal edge and being operable under pressure between a closed condition and an open condition and maintained in one of said open and closed conditions in the absence of pressure, wherein said first layer peripheral edge, said second layer peripheral edge and said ribbon switch longitudinal edge are disposed in a coplanar relationship to form a peripheral edge of said electrical switch mat.

2. An electrical switch mat as defined in claim 1, further comprising at least one interior ribbon switch disposed between said first layer and said second layer and spaced inwardly from said perimeter ribbon switch.

3. An electrical switch mat as defined in claim 2, wherein the electrical switch mat is pressure-sensitive across the entire surface of said first and second layers.

4. An electrical switch mat as defined in claim 1, wherein said first layer peripheral edge, said second layer peripheral edge and said ribbon switch longitudinal edge are bonded together.

5. An electrical switch mat as defined in claim 1, wherein said flexible matting material of said first layer and said second layer is an elastic water-resistant material.

6. An electrical switch mat as defined in claim 1, wherein said first layer peripheral edge, said second layer peripheral edge and said ribbon switch longitudinal edge define a continuous perimeter of said electrical switch mat.

7. An electrical switch mat as defined in claim 1, wherein said perimeter ribbon switch comprises a pair of vertically spaced electrical conductors enclosed in an insulative jacket, said conductors being urged into electrical engagement upon compression of at least one of said first and second layers to activate said perimeter ribbon switch.

8. An electrical switch mat as defined in claim 1, wherein said perimeter ribbon switch comprises a first switch portion electrically and structurally connected to a second switch portion, said first and second switch portions defining a corner.

9. An electrical switch mat as defined in claim 8, wherein each of said first and second switch portions comprise a pair of vertically spaced electrical conductors enclosed in an insulative jacket, said conductors being urged into electrical engagement upon compression of at least one of said first and second layers to activate said perimeter ribbon switch, and wherein said electrical conductors and insulative jacket of said first switch portion are joined with said electrical conductors and insulative jacket of said second switch portion at said corner.

10. An electrical switch mat as defined in claim 9, wherein said electrical conductors and insulative jacket of said first switch portion are joined to said electrical conductors and insulative jacket of said second switch portion at about a 45 degree angle.

11. An electrical switch mat as defined in claim 1, wherein said first layer of flexible matting material includes an inclined ramp portion adjacent said peripheral edge for minimizing tripping on said switch mat.

12. In combination:

a first electrical switch mat including first and second layers of flexible matting material and a pressure sensitive perimeter ribbon switch disposed between said first and second layers at a peripheral edge thereof; and a second electrical switch mat including first and second layers of flexible matting material and a pressure sensitive perimeter ribbon switch disposed between said first and second layers at a peripheral edge thereof, wherein said peripheral edge of said first electrical switch mat abuts against said peripheral edge of said second electrical switch mat, whereby there are no inactive areas of pressure sensitivity between said first and second electrical switch mats.

13. A combination as defined in claim 12, wherein said pressure-sensitive perimeter switches of said first and second electrical switch mats each include a longitudinal edge, said longitudinal edge of said first switch mat ribbon switch abutting against said longitudinal edge of said second switch mat ribbon switch.

14. A combination as defined in claim 13, wherein said first layer peripheral edge, said second layer peripheral edge and said ribbon switch longitudinal edge define a continuous perimeter of each of said first and second electrical switch mats.

15. A combination as defined in claim 12, wherein each of said first and second electrical switch mats further comprise at least one interior ribbon switch disposed between said first and second layers and spaced inwardly from said perimeter ribbon switch.

16. A combination as defined in claim 12, wherein said flexible matting material of said first and second layers of each of said first and second switch mats is an elastic water-resistant material.

17. A combination as defined in claim 12, wherein said perimeter ribbon switch of each of said first and second switch mats comprises a pair of vertically spaced electrical conductors enclosed in an insulative jacket, said conductors being urged into electrical engagement upon compression of at least one of said first and second layers to activate said perimeter ribbon switch.

18. A combination as defined in claim 12, wherein said perimeter ribbon switch of each of said first and second switch mats comprises a first switch portion electrically and structurally connected to a second switch portion, said first and second switch portions defining a corner.

19. A combination as defined in claim 18, wherein each of said first and second switch portions comprise a pair of vertically spaced electrical conductors enclosed in an insulative jacket, said conductors being urged into electrical engagement upon compression of at least one of said first and second layers to activate said perimeter ribbon switch, and wherein said electrical conductors and insulative jacket of said first switch portion are joined with said electrical conductors and insulative jacket of said second switch portion at said corner.

20. A combination as defined in claim 19, wherein said electrical conductors and insulative jacket of said first switch portion are joined to said electrical conductors and insulative jacket of said second switch portion at about a 45 degree angle.

* * * * *